US010405087B2

(12) United States Patent
Graber

(10) Patent No.: US 10,405,087 B2
(45) Date of Patent: Sep. 3, 2019

(54) RADIAL ACOUSTIC SPEAKER

(71) Applicant: Curtis E. Graber, Woodburn, IN (US)

(72) Inventor: Curtis E. Graber, Woodburn, IN (US)

( * ) Notice: Subject to any disclaimer, the term of this patent is extended or adjusted under 35 U.S.C. 154(b) by 0 days.

(21) Appl. No.: 15/683,061

(22) Filed: Aug. 22, 2017

(65) Prior Publication Data

US 2018/0054672 A1 Feb. 22, 2018

Related U.S. Application Data

(60) Provisional application No. 62/378,002, filed on Aug. 22, 2016.

(51) Int. Cl.

| | |
|---|---|
| ***H04R 1/30*** | (2006.01) |
| ***H04R 3/12*** | (2006.01) |
| ***H04R 1/02*** | (2006.01) |
| ***H04R 5/04*** | (2006.01) |
| ***H04R 1/32*** | (2006.01) |
| ***H04R 5/02*** | (2006.01) |
| ***H04R 1/40*** | (2006.01) |

(52) U.S. Cl.

CPC ..... *H04R 1/30* (2013.01); *H04R 1/025* (2013.01); *H04R 1/323* (2013.01); *H04R 1/403* (2013.01); *H04R 3/12* (2013.01); *H04R 5/02* (2013.01); *H04R 5/04* (2013.01); *H04R 2201/401* (2013.01)

(58) Field of Classification Search

CPC . H04R 1/30; H04R 1/403; H04R 5/02; H04R 1/323; H04R 1/025; H04R 3/12; H04R 5/04

See application file for complete search history.

(56) References Cited

U.S. PATENT DOCUMENTS

| | | | | |
|---|---|---|---|---|
| 2,869,669 A * | 1/1959 | Leslie | ..... | F16L 59/08 181/143 |
| 5,146,508 A * | 9/1992 | Bader | ..... | G10K 9/22 381/342 |
| 8,265,320 B2 * | 9/2012 | Datz | ..... | H04R 1/30 381/342 |

* cited by examiner

*Primary Examiner* — Brian Ensey
(74) *Attorney, Agent, or Firm* — Taylor IP, P.C.

(57) ABSTRACT

A radial acoustic speaker assembly including a transducer and a plurality of segmented spiral horns acoustically coupled to the transducer. Each of the segmented spiral horns have an acoustical path. The plurality of segmented spiral horns include a first segmented spiral horn and a second segmented spiral horn. The first segmented spiral horn being adjacent to the second segmented spiral horn, and the first segmented spiral horn and the second segmented spiral horn have substantially identical shapes.

17 Claims, 7 Drawing Sheets

RADIAL ACOUSTIC SPEAKER

CROSS REFERENCE TO RELATED APPLICATIONS

This is a non-provisional application based upon U.S. provisional patent application Ser. No. 62/378,002, entitled "ACOUSTIC SPEAKER", filed Aug. 22, 2016, which is incorporated herein by reference.

BACKGROUND OF THE INVENTION

1. Field of the Invention

The present invention relates to acoustic speakers that radiate sound in a radial manner.

2. Description of the Related Art

A speaker is a type of electro-acoustic transducer, which is a device that converts an electrical audio signal into sound or acoustic energy corresponding to the signal. Speakers were invented during the development of telephone systems in the late 1800s. However, it was electronic amplification, initially by way of vacuum tube technology beginning around 1912 that began to make speaker systems practical. The amplified speaker systems were used in radios, phonographs, public address systems and theatre sound systems for talking motion pictures starting in the 1920s.

The dynamic speaker, which is widely used today, was invented in 1925 by Edward Kellogg and Chester Rice. A principle of the dynamic speaker is when an electrical audio signal input is applied through a voice coil, which is a coil of wire suspended in a circular gap between the poles of a permanent magnet, the coil is forced to move rapidly back and forth due to Faraday's law of induction. The movement causes a diaphragm, which is generally conically shaped, and is attached to the coil to move back and forth, thereby inducing movement of the air to create sound waves.

Speakers are typically housed in an enclosure and if high quality sound is required, multiple speakers may be mounted in the same enclosure, with each reproducing part of the audio frequency range. In this arrangement the speakers are individually referred to as "drivers" and the entire enclosure is referred to as a speaker or a loudspeaker. Small speakers are found in various devices such as radio and TV receivers, and a host of other devices including phones and computer systems.

A problem with speaker systems in outdoor or arena applications is the lack of uniform distribution of sound. Generally, multiple speakers are arranged to point outwardly in a quasi-circular arrangement to attempt to generate and direct acoustic energy to various points of the venue. This arrangement results in inadequate sound distribution and reduced quality of the sound.

What is needed in the art is an electro-acoustic transducer that can be used with speakers or other devices which has increased effectiveness that will allow more compact designs and will result in more efficient production of sound.

SUMMARY OF THE INVENTION

The present invention provides a radially segmented speaker system.

The invention in one form is directed to a radial acoustic speaker assembly including a transducer and a plurality of segmented spiral horns acoustically coupled to the transducer. Each of the segmented spiral horns have an acoustical path. The plurality of segmented spiral horns include a first segmented spiral horn and a second segmented spiral horn. The first segmented spiral horn being adjacent to the second segmented spiral horn, and the first segmented spiral horn and the second segmented spiral horn have substantially identical shapes.

The invention in another form is directed to a speaker assembly including a first radial acoustic speaker and a second radial acoustic speaker stacked on the first radial acoustic speaker. Both the first radial acoustic speaker and the second radial acoustic speaker each have a transducer and a plurality of segmented spiral horns acoustically coupled to the transducer. Each of the segmented spiral horns having an acoustical path. The plurality of segmented spiral horns include a first segmented spiral horn and a second segmented spiral horn. The first segmented spiral horn is adjacent to the second segmented spiral horn, and the first segmented spiral horn and the second segmented spiral horn have substantially identical shapes.

An advantage of the present invention is an efficient electrical conversion to acoustic energy is achieved.

Another advantage of the present invention is that the horns are compactly arrange yet provide a truly radial sound distribution.

Yet another advantage of the present invention is that the sound produced from the speaker system is isophasic at the mouths of each horn as it is projected outwardly.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
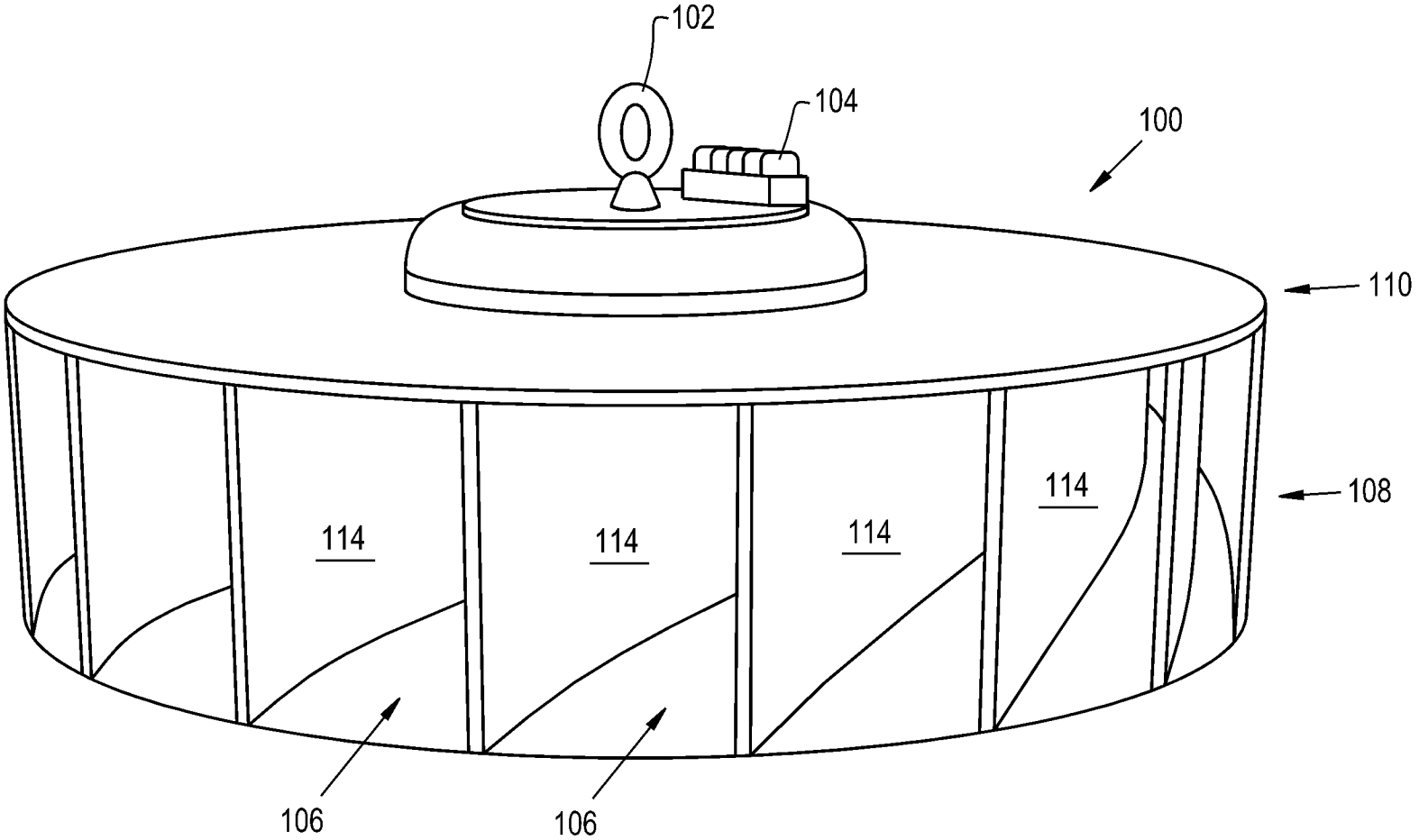
FIG. 1 is a perspective view of an embodiment of a radial acoustic speaker of the present invention.

Referring now to the drawings, and more particularly to FIG. 1, there is shown a radial acoustic speaker 100 having a hanging or connecting feature 102, electrical connections 104 and speaker horns 106 arranged around the peripheral of the generally circular shape. Speaker 100 can also be considered a radially twisted annular waveguide 100, as will be discussed further herein. Radial acoustic speaker 100 has a lower assembly 108 and an upper assembly 110. Lower assembly includes walls 114 that serve to segment each acoustic path section.

Figure 2:
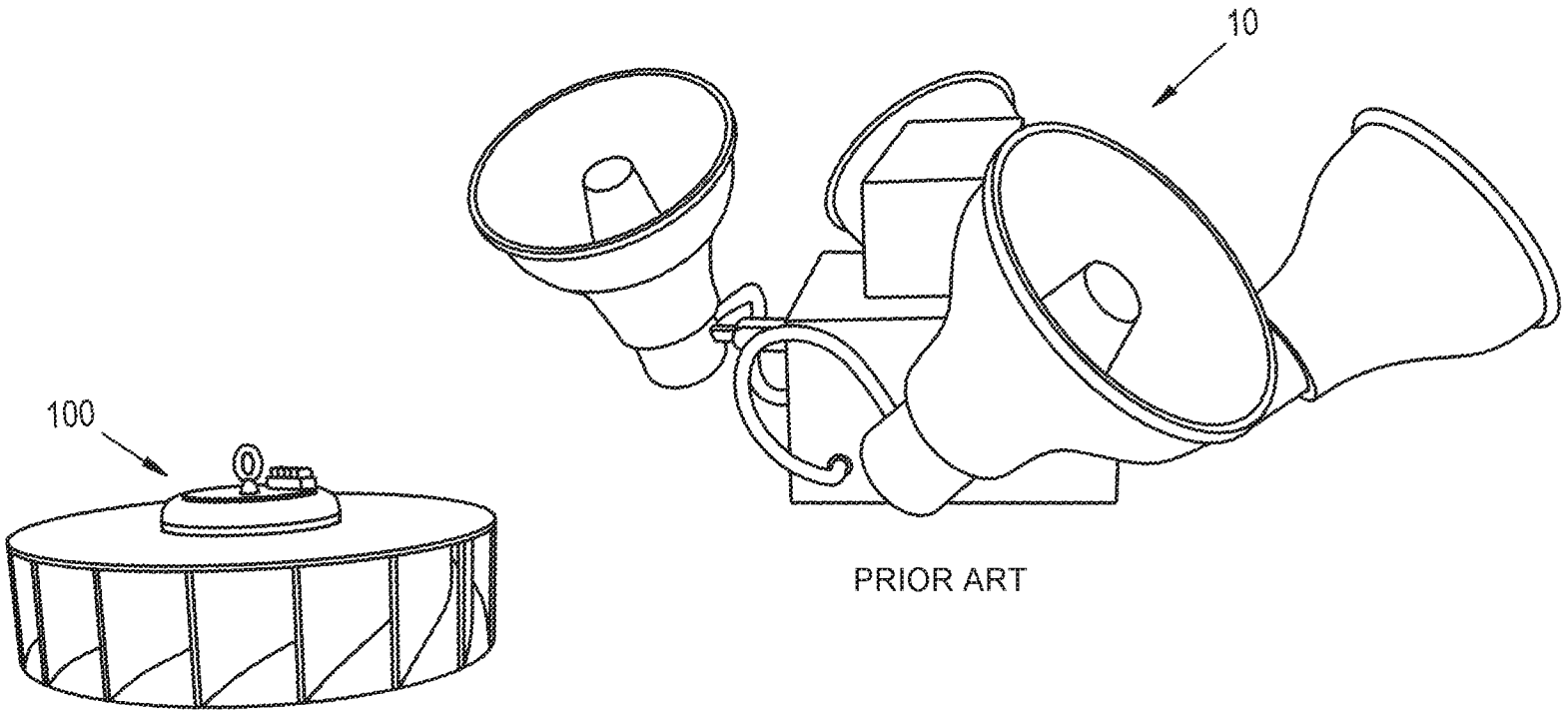
PRIOR ART Fig. 2
FIG. 2 is a comparison of the present invention with a prior art system.

Now, additionally referring to FIG. 2 there is shown an embodiment of the inventive speaker 100 next to a prior-art unit 10. Speaker 100 has not only the evident size advantage, but important performance characteristics discussed herein over the prior-art unit 10.

Figure 3:
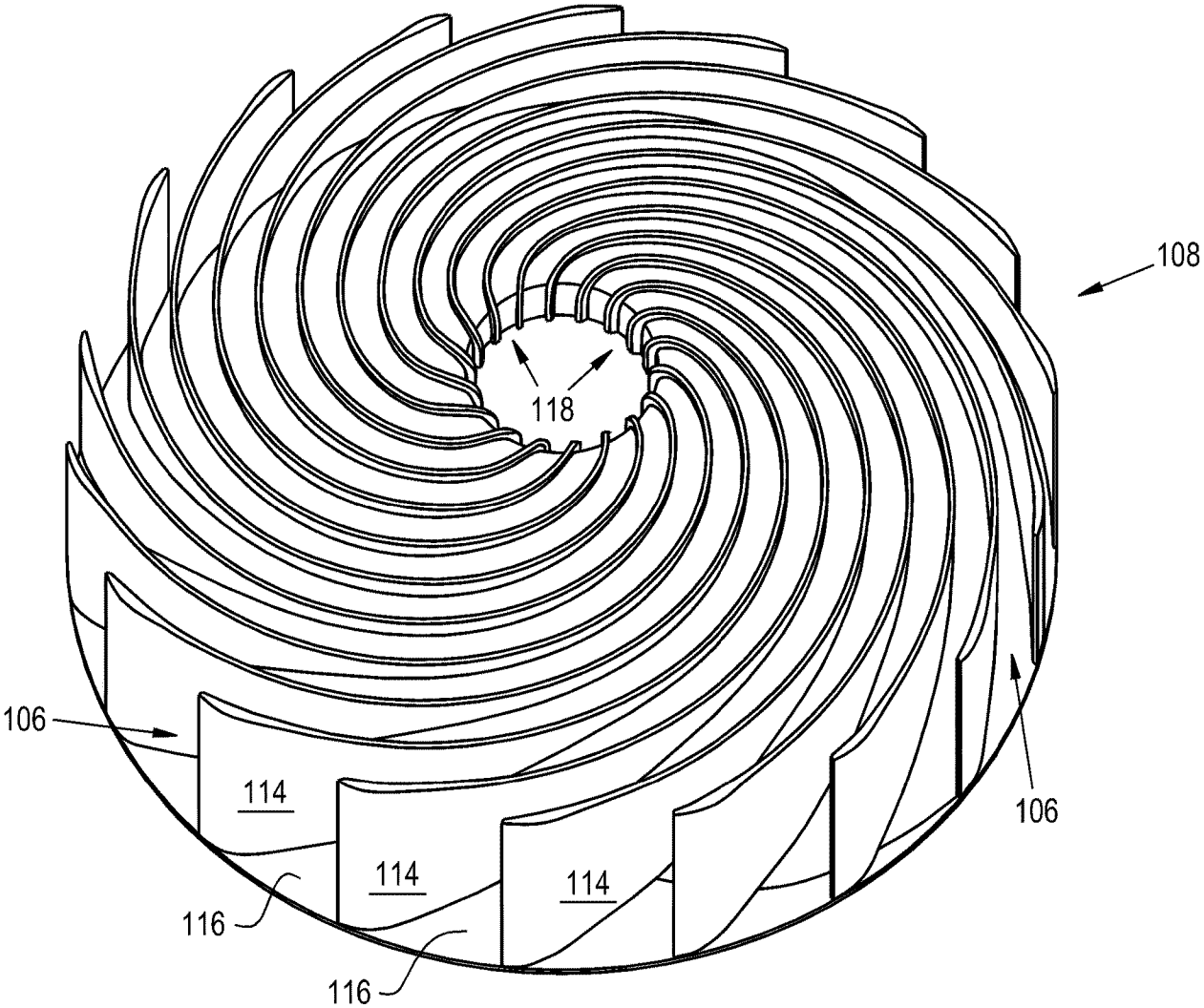
FIG. 3 is a perspective view of acoustic pathways of the speaker of FIG. 1 with the driver and the top removed.

Now, additionally referring to FIG. 3 there is illustrated some of the internal features of lower assembly 108. The shape of a floor 116 and the ever expanding distance between walls 114 as the passageway of horns 106 expand, serve to guide the acoustic waveforms generated by the driver unit 112. Horns 106 are segmented spiral horns 106 that are adjacent to one another sharing the construct of a common wall 114 to thereby form a radially symmetrical construct with the mouths being aligned radially about central axis CA and extending for 360 degrees about axis CA.

Figure 4:
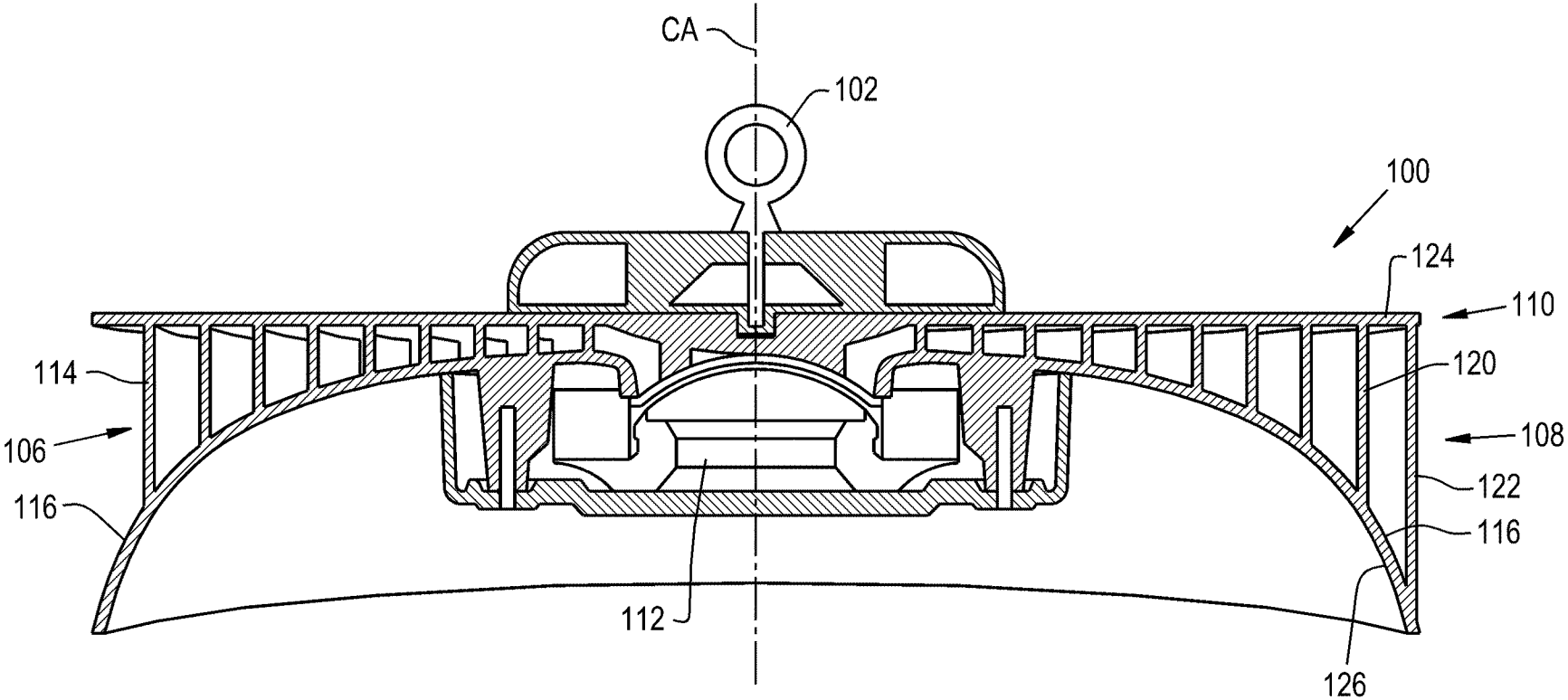
FIG. 4 is a cross-sectional view of the radial acoustic speaker of FIGS. 1 and 3.

Now, additionally referring to FIG. 4, there is shown a cross-sectional view of speaker 100. A lower assembly 108 is covered with an upper assembly 110 to form speaker 100. A driving unit 112 is located at a center portion of lower assembly 108. A series of walls 114 and a floor 116 along with upper assembly 110 serve to define the shape and length of horns 106. There is a great deal of symmetry about a central axis CA with respect to the outward projection of sound as well as the structure of the elements of radial acoustic speaker 100. As horns 106 expand outwardly from transducer 112, they form a spiral acoustic path that can be seen in FIG. 3. The shape of the four walls of each horn 106 can be seen in the cross-sectional view of FIG. 4, where interior surfaces 120, 122, 124 and 116 are illustrated for a representative section of a horn 106. Interior wall surfaces 120 and 122 are parallel with or substantially parallel with central axis CA and interior wall surface 124 is perpendicular with or substantially perpendicular with central axis CA. Interior wall surface 116 is curved along a path that parallels the concave shape of outer surface 126, although it is understood that the spiral shape of the acoustic path of horn 106 is such that as the acoustic energy traverse the acoustic path the path is on a downward slope as the acoustic energy nears a mouth of horn 106. Although interior wall surface 116 is curved along the acoustic path, it is also contemplated that surface 116 could be a stepped surface. The cross-sectional area along the acoustic pathway is set to follow a tractrix form, an exponential form or another divergent arrangement.

Transducer 112 is centrally located in radial acoustic speaker 100 lying on central axis CA and is shown as being radially symmetrical relative to central axis CA. Transducer 112 has a moveable portion that moves axially along axis CA, to thereby produce the acoustic energy that traverses the acoustic pathways of horns 106.

Figure 5:
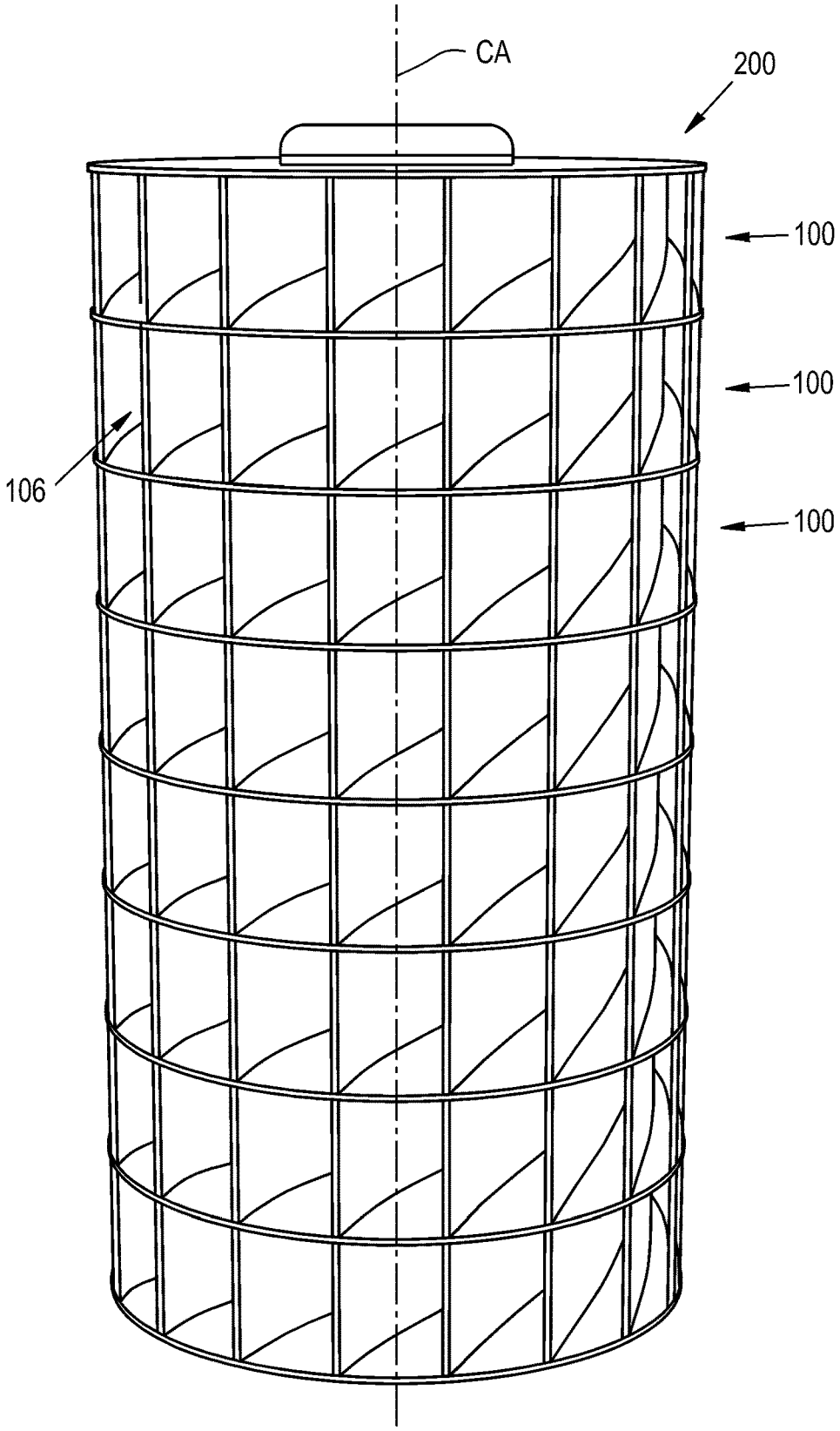
FIG. 5 illustrates the stackable nature of the speaker of FIGS. 1, 3 and 4.

Now, additionally referring to FIG. 5 there is illustrated a modular feature of speaker 100, where several speakers 100 are shown stacked to form a speaker assembly 200. Although the same number of horns 106 in each speaker 100 is shown, it is contemplated that differing numbers of horns 106 can be utilized in separate speakers 100. The electrical connection of radial acoustic speakers 100 can be coupled internally with an electrical connector system, not separately illustrated herein. Radial acoustic speaker system 200 allows for the stacking of numerous speakers 100 to conveniently allow for increasing speaker output power in an integrated package.

Figure 6:
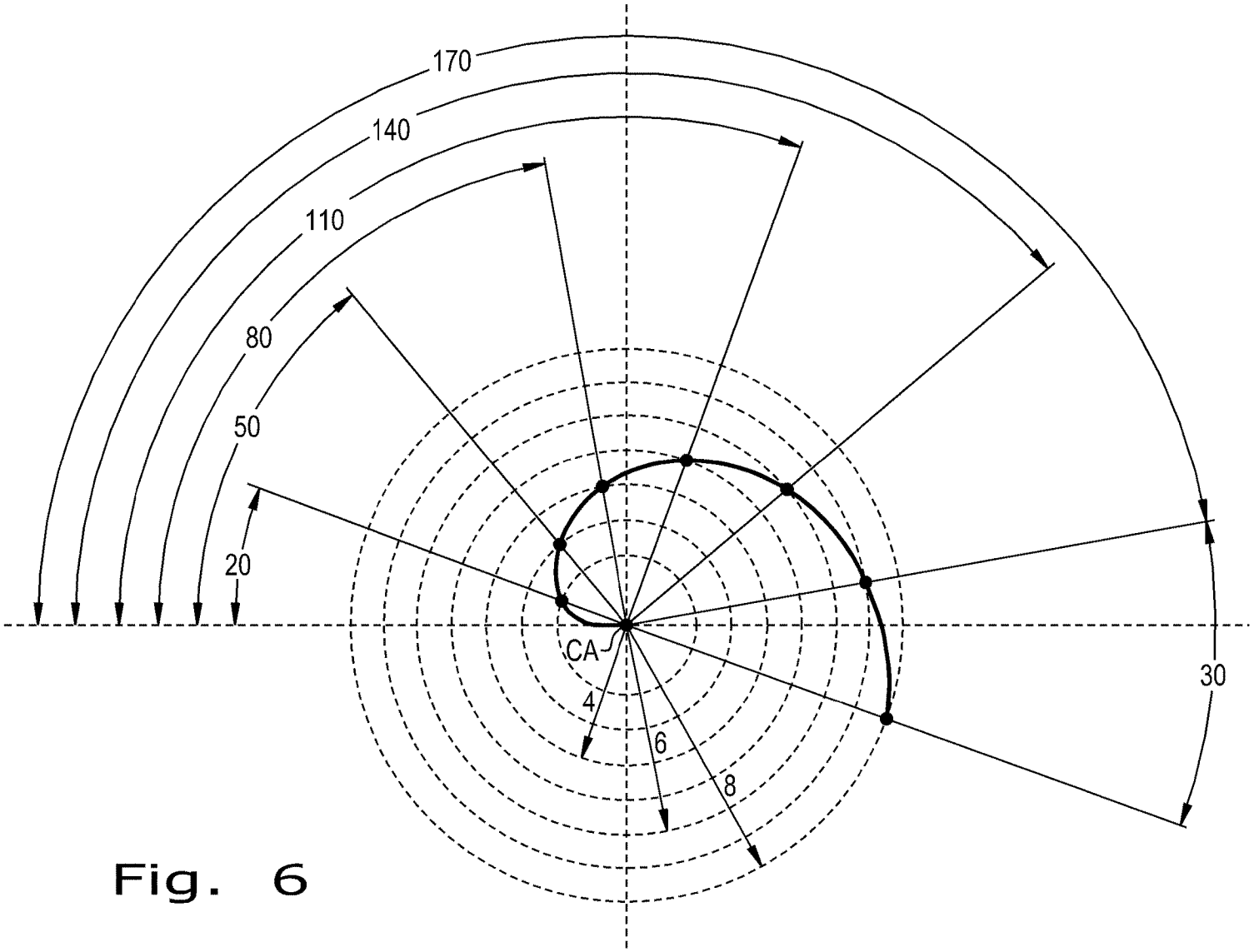
FIG. 6 illustrates the shape of a wall of one of the segmented sections of the radial acoustic speaker of FIGS. 1 and 3-5.

Now, additionally referring to FIGS. 3 and 6, there is illustrated how the shape of walls 114 are determined as viewed looking down on the top of lower assembly 108. The curve is a complex conic that differs in both x and y and z axis as the path extends. In the example illustrated in FIG. 6, the total horn area is calculated by a tractrix formula.

$$x=a*\ln((a+\mathrm{sqrt}(a\hat{}2-r\hat{}2)/r)-\mathrm{sqrt}(a\hat{}2-r\hat{}2)$$

where:

x is the distance from the mouth of the horn, a is the radius at the mouth, and r is the radius at distance x from the mouth.

The 'spiral' horn walls are formed by splines. The splines are curves of constantly changing radius that pass through a series of fit points creating a smooth continuity between points. This 2D (X/Y axis) 'spiral' walls are adjusted to assure two adjacent walls provide a nominal width that constantly expands from throat of the horn to the mouth of the horn.

In this instance, a spline was created using eight fit points illustrated by FIG. 6. These fit points are positioned radially from the center of the circle and angularly from the first point.

Below is a description of each fit point.

0" 0-degrees
2" 20-degrees
3" 50-degrees
4" 80-degrees
5" 110-degrees
6" 140-degrees
7" 170-degrees
8" 200-degrees The beginning of the spline is constrained tangentially on the 0-degree line and the end is constrained using a minimum energy method. The 3D horn is then created by expanding each horn sections' open area in the Z axis to equal the area calculated from the tractrix formula listed above divided by the number of spiral sections, thereby defining the shape of floor 116. In the illustrated embodiment the desire is to create a speaker that radiates sound out and generally down, so the top surface of horn 106 has been kept flat. It is also contemplated to curve the top surface as well as floor 116, to thereby direct sound in a differing direction, such as a symmetrically vertical sound distribution.

The flow of acoustic energy starts at driving unit 112 and enters each horn 106 around an inner periphery located at 118, where the sound waves enter traveling generally upward along the channels of each horn 106 that then transition to the outwardly directed spline construct previously described, as can be seen to some extent in FIG. 3. The acoustic pathway of each horn 106 starts proximate to the central axis CA and curves at least 45 degrees, or more than 90 degrees or more than 180 degrees about axis CA (or it is contemplated for it to curve more than 360 degrees) with the acoustic pathway being longer than the diameter of speaker 100.

Figure 7:
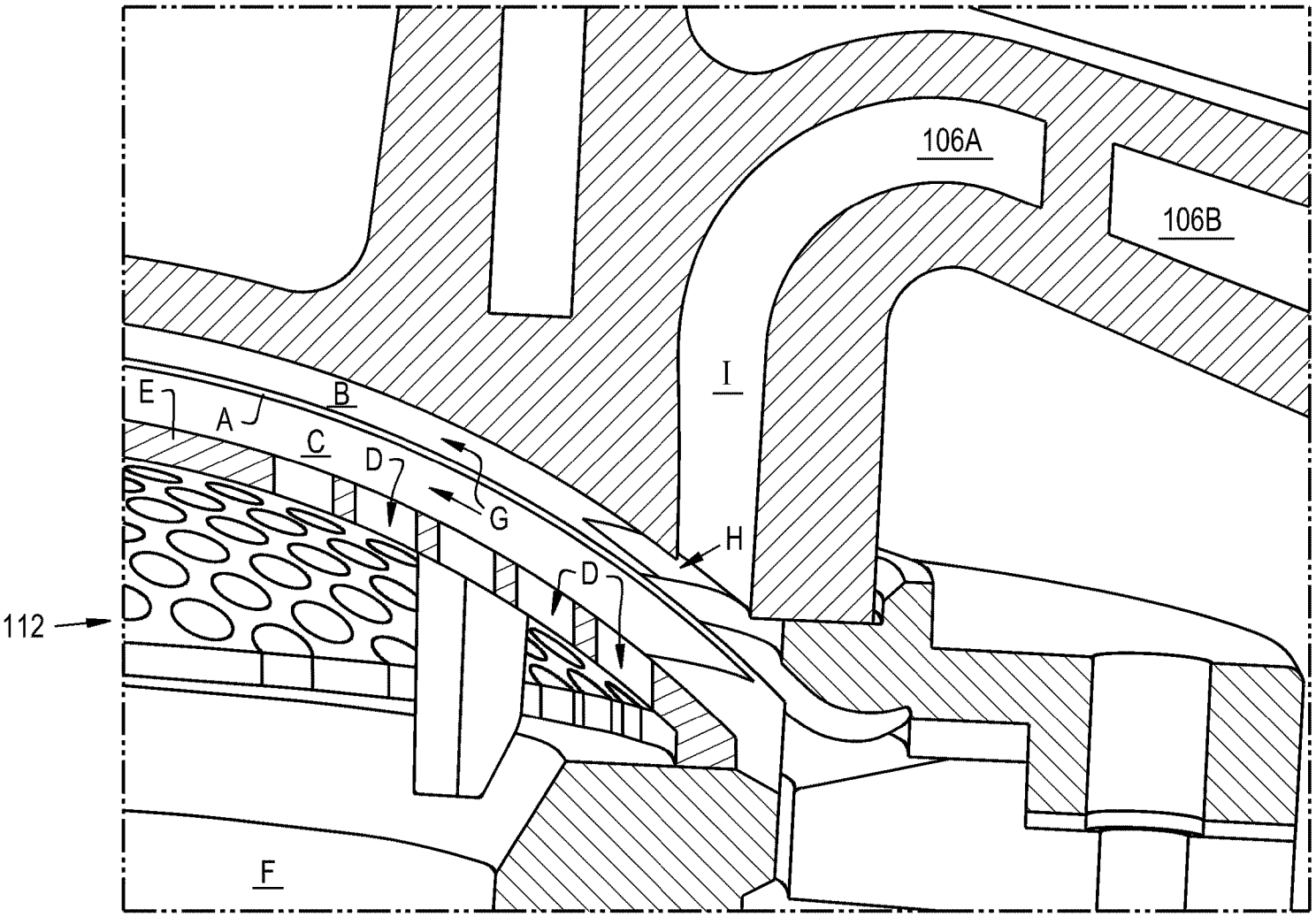
FIG. 7 is a cross-sectional view of a portion of the transducer and a portion of a throat of an acoustic pathway of the speaker of FIGS. 1 and 3-6.

Now, additionally referring to FIG. 7, there is shown a close up sectioned view of part of power unit 112, where a vibratory dome piston assembly A is shown with an airspace B, an airspace C, perforations D, solid portion E, a tuned rear air volume F, an aperture H, and horn 106A throat I.

Airspace B is between dome A and a generally parallel solid surface above, that is effectively an airspace forward intimate boundary, with airspace C, between dome A and portion E, being a rearward intimate boundary. These airspaces B and C effectively function as air-springs G along with F storing/providing energy from/to dome A. Perforations D extend through portion E on the radially outer portions of the "anti-mode" device E.

Tuned rear air volume F allows driver 112 to lower its natural resonance and increase its performance at lower frequencies. Air springs G, between the moving dome piston A and the non-moving forward and aft boundaries serve to not allow the dissipation of energy from most of the dome A, but allow energy to flow into aperture H passing through throat I and out of horn (in this case) 106A. Due to the nature of the cross-sectional view and the curvature of much of the horns 106 part of the passageway of a horn 106B can be seen, which is adjacent to horn 106A.

Apertures H are radially positioned around the outer portion of dome A, and the construct can be considered a radial segmented acoustic harvest aperture, that is located around the outer circumference of the dome piston A. The initial horn throat is shown as area I (horn expansion starts at the aperture H and continues through to the radial mouth of each horn 106).

It is contemplated that the acoustic sources in the form of driver unit 112 could be, at least, cone, dome, flat planar or ring radiator piston configurations. The current inventive device 100 uses a dome A but harvests energy from only the outer perimeter so it replicates a pseudo-ring radiator from a conventional dome radiation piston.

Advantages of a pseudo-ring radiator is that it renders essentially acoustically null in the areas of non-harvest both in front of and behind dome A with a closely spaced acoustic boundary that conforms to the surface of the piston. With this intimate boundary on both sides of dome A the material mass of dome A is negated from the air spring effect resulting in a piston of lower effective moving mass than the actual moving piston part. Lower moving mass equals higher acceleration of the piston and thus higher efficiencies.

While this methodology is being used to generate pseudo-ring radiator performance in the present example, it is also contemplated to use a true ring radiator acoustic source device or a conventional piston device.

Device 100 produces an extremely high electrical to sound conversion efficiency of >40%, or >50% or even >60% much due to the significant decrease in the apparent dome piston moving mass, and the close match of the transducers extremely high BL product to the efficient horn design.

If a unit were to be built with the horn in a conventional directional (such as a straight) configuration it would have a mouth area of 24"×12" and a length of 19" rather than a compact 15" diameter and 6" tall cylindrical package.

The present invention uses a compact method of attaining low frequency horn loading of a simple acoustic source to an annular radial Omni-directional acoustic aperture.

The present invention provides for the isophasic arrival of acoustic output to all 18 annular mouth sections from a central located singular or multiple acoustic source. The spiraled configuration of the waveguides accommodate a much longer waveguide length then what could be attained in a non-spiraled radial waveguide. The angled down acoustic aperture produces an increased acoustic output in the 22-60 degrees down angle from speaker 100.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A radial acoustic speaker assembly, comprising:

a transducer; and a plurality of segmented spiral horns acoustically coupled to the transducer, each of the segmented spiral horns having an acoustical path, the plurality of segmented spiral horns including a first segmented spiral horn and a second segmented spiral horn, the first segmented spiral horn being adjacent to the second segmented spiral horn, the first segmented spiral horn and the second segmented spiral horn having substantially identical shapes, the speaker assembly having a central axis about which the segmented spiral horns symmetrically extend, the segmented spiral horns each have a first interior wall surface, a second interior wall surface, a third interior wall surface and a fourth interior wall surface, with the first interior wall surface and the third interior wall surface being substantially parallel with the central axis, the fourth interior wall surface extending symmetrically radially outward from the central axis along a curve or a stepped surface.

2. The radial acoustic speaker assembly of claim 1, wherein the acoustical path of the first segmented spiral horn and the acoustical path of the second segmented spiral horn have a common wall therebetween.

3. The radial acoustic speaker assembly of claim 1, wherein the transducer has an axis of movement, the first interior wall surface and the third interior wall surface being substantially parallel with the axis of movement.

4. The radial acoustic speaker assembly of claim 3, wherein the second interior wall surface is substantially perpendicular to the axis of movement of the transducer.

5. The radial acoustic speaker assembly of claim 3, wherein lengths of the interior wall surface vary along the acoustical path of each segmented spiral horn such that a cross-sectional area of the horn follows one of a tractrix formula and an exponential formula.

6. The radial acoustic speaker assembly of claim 1, wherein the plurality of segmented spiral horns extend for 360 degrees about a central axis of the speaker assembly.

7. The radial acoustic speaker assembly of claim 6, wherein the transducer is a singular transducer that feeds acoustic energy into each of the segmented spiral horns in a substantially equal manner.

8. The radial acoustic speaker assembly of claim 1, wherein the speaker assembly has a diameter, each acoustic path having a length that is longer than the diameter.

9. The radial acoustic speaker assembly of claim 8, wherein each acoustic path starts proximate to the central axis and curves at least 180 degrees around the central axis.

10. The radial acoustic speaker assembly of claim 1, further comprising:

an other transducer; and an other plurality of segmented spiral horns acoustically coupled to the other transducer, both the plurality of segmented spiral horns and the other plurality of segmented spiral horns separately extend for 360 degrees about a central axis of the speaker assembly, the transducer and the other transducer each being situated on the central axis, spaced apart from each other along the central axis.

11. The radial acoustic speaker assembly of claim 1, further comprising an outer wall that is parallel to the fourth interior wall surfaces of each of the segmented spiral horns, the outer wall being concave in shape.

12. A speaker assembly, comprising:

a first radial acoustic speaker; and a second radial acoustic speaker stacked on the first radial acoustic speaker, both the first radial acoustic speaker and the second radial acoustic speaker each having:

a transducer; and a plurality of segmented spiral horns acoustically coupled to the transducer, each of the segmented spiral horns having an acoustical path, the plurality of segmented spiral horns including a first segmented spiral horn and a second segmented spiral horn, the first segmented spiral horn being adjacent to the second segmented spiral horn, the first segmented spiral horn and the second segmented spiral horn having substantially identical shapes, the speaker assembly having a central axis about which the segmented spiral horns symmetrically extend, the segmented spiral horns each have a first interior wall surface, a second interior wall surface, a third interior wall surface and a fourth interior wall surface, with the first interior wall surface and the third interior wall surface being substantially parallel with the central axis, the fourth interior wall surface extending symmetrically radially outward from the central axis along a curve or a stepped surface.

13. The speaker assembly of claim 12, wherein the acoustical path of the first segmented spiral horn and the acoustical path of the second segmented spiral horn have a common wall therebetween.

14. The radial acoustic speaker assembly of claim 12, wherein the transducer has an axis of movement, the first interior wall surface and the third interior wall surface being substantially parallel with the axis of movement.

15. The speaker assembly of claim 12, wherein the plurality of segmented spiral horns of each radial acoustic speaker extends for 360 degrees about a central axis of the radial acoustic speaker.

16. The speaker assembly of claim 12, wherein each radial acoustic speaker has a central axis, with the radial acoustic speaker having a diameter, each acoustic path having a length that is longer than the diameter.

17. The assembly of claim 16, wherein each acoustic path starts proximate to the central axis and curves at least 180 degrees around the central axis.

* * * * *